United States Patent [19]

Garman

[11] 3,946,718

[45] Mar. 30, 1976

[54] QUICK-DETACHABLE ARCHERY QUIVER

[76] Inventor: Burdette Mallory Garman, 3142 Wiltshire Drive, Avondale Estates, Ga. 30002

[22] Filed: Aug. 28, 1972

[21] Appl. No.: 284,408

[52] U.S. Cl. ..... 124/30 R; 224/1 B

[51] Int. Cl.[2] ..... F41B 5/06

[58] Field of Search.... 124/24 A, 23 A, 30 R, 24 R, 124/23 R, 41, 45; 221/1 B

[56] References Cited

UNITED STATES PATENTS

| | | | |
|---|---|---|---|
| 3,097,624 | 7/1963 | Bergquist | 124/23 R X |
| 3,116,730 | 1/1964 | Tingley | 124/48 X |
| 3,366,101 | 1/1968 | Saunders | 124/23 A |
| 3,490,662 | 1/1970 | Ramsey | 124/24 A |

*Primary Examiner*—Richard C. Pinkham
*Assistant Examiner*—William R. Browne

[57] ABSTRACT

An elongated vertical bar or "spine" at its top carries an inverted cup containing a sponge plastic bottom pad for receiving the pointed tips of hunting arrows, and near its lower end carries a circumferentially key-hole-notched plate of resilient material fastened to one of a series of vertically-spaced holes in said bar. Secured to two others of these holes are two vertically-spaced upper and lower bow-attachment angle brackets adapted to be detachably attached to the bow by resilient O-rings looped around them and around the bow.

4 Claims, 6 Drawing Figures

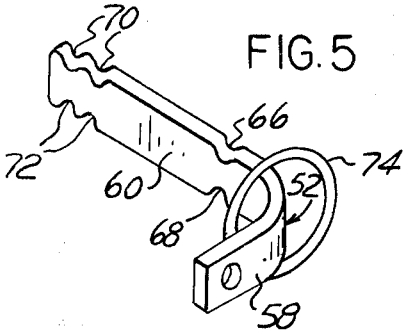
FIG. 5
FIG. 2
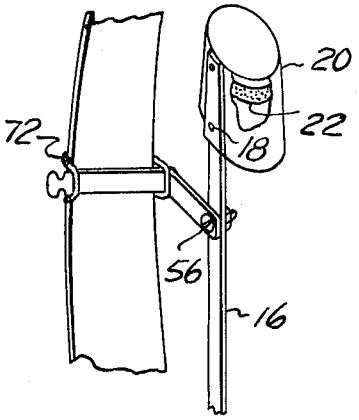
FIG. 6
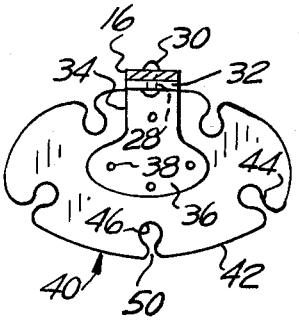
FIG. 3
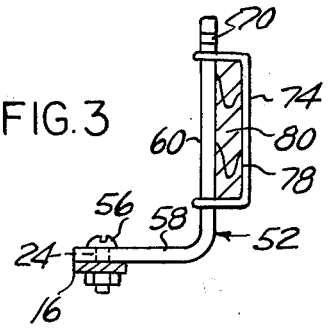
FIG. 4
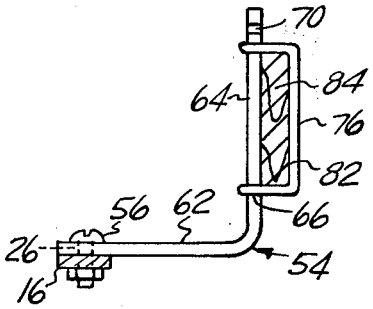
FIG. 1
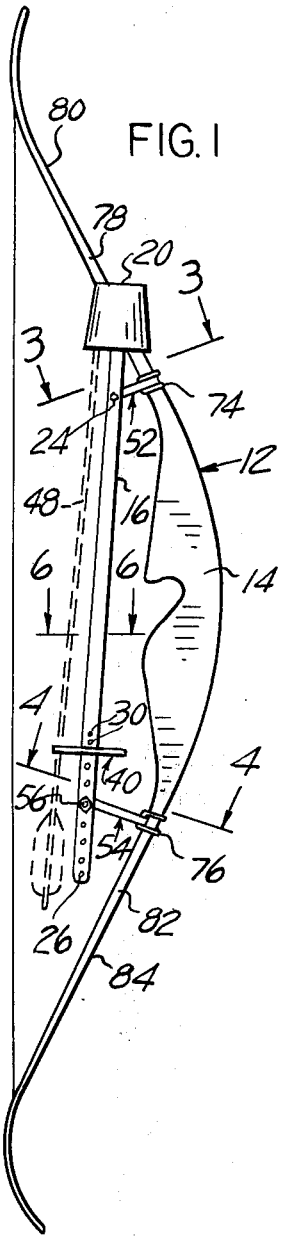

QUICK-DETACHABLE ARCHERY QUIVER

SUMMARY OF THE INVENTION

The quiver is quickly and easily attached to or detached from the bow by looping or unlooping the O-rings which extend from the inner end of each angle bracket around the bow to the outer end of the same angle bracket. This enables the arrows in the keyhole notches of the quiver to be rendered instantly accessible during hunting yet quickly and easily detached from the bow when the hunt is over and the quiver and bow are most conveniently transported separately. The spine located at the side of the cup and at the side of the keyhole-slotted plate serves to protect the arrows from contact with tree branches, brush and the like during hunting.

In the drawing,

FIG. 1 is a view, on a reduced scale, of a hunting archery bow equipped with the quick-detachable quiver of the present invention, with an arrow indicated in dashed lines;

FIG. 2 is an enlarged perspective view, partly broken away, of the upper part of the quiver, attached to the bow;

FIGS. 3 and 4 are enlarged approximately horizontal sections taken along the lines 3—3 and 4—4 in FIG. 1;

FIG. 5 is an enlarged perspective view of one of the upper quiver-attaching angle brackets, removed from the spine, and encircled by an O-ring in its relaxed position; and FIG. 6 is an enlarged horizontal section taken along the line 6—6 in FIG. 1, showing the keyhole-notched arrow-holding plate and its attachment bracket secured to the spine.

Referring to the drawing in detail, FIG. 1 shows a quick-detachable archery quiver, generally designated 10, mounted on a hunting archery bow 12, according to one form of the present invention. The bow 12 is conventional and its details are beyond the scope of the present invention. The quiver 10 is attached to the bow 12 at locations closely adjacent the upper and lower ends of the hand grip 14 thereof in the manner described below.

The quiver 10 has a single elongated approximately vertical support bar or spine 16, to the upper end of which is fastened, as by rivets 18, an arrow head cover or upper arrow holder in the form of an inverted cup 20 of oval cross-section. Secured as by an adhesive to the bottom of the cup 20 on the inside thereof is a sponge plastic or sponge rubber pad 22 for penetration by the pointed arrow tips. The cup 20 is conveniently made of synthetic plastic material. The spine 16 is conveniently made of wood, light metal or plastic and near its upper end is provided with an upper fastener hole 24 while extending upward from its lower end are multiple vertically-spaced lower fastener holes 26. Above the upper end of this series of holes 26 are two closely-spaced holes 28 which receive rivets 30 or other suitable fasteners (FIG. 6) securing the upper arm 32 of an angle bracket 34 to the spine 16. The other arm 36 of the angle bracket 34 is drilled for the reception of fasteners 38, such as rivets, which secure to it an oval arrow-holding plate 40 of resilient material such as rubber provided at spaced intervals around its peripheral edge 42 with keyhole notches 44, the circular inner portions 46 of which are slightly less in diameter than the diameter of the shaft of an arrow 48 so as to lightly grip the shaft whereas the slot portions or necks 50 extending outward to the peripheral edge 42 are considerably narrower. The result is that the shaft of the arrow 48 must be pushed forcibly through the slot portions or necks 50 into the circular inner portions 46, and yieldingly held therein.

Mounted near the opposite ends of the spine in the upper hole 24 and in one of the lower fastener holes 26 are L-shaped upper and lower bow-attachment angle brakcets 52 and 54 of vertically-elongated cross-section (FIGS. 3 and 4) respectively secured therein by bolts or other suitable fasteners 56. The two attachment brackets 52 and 54 are of similar construction and differ only in the lengths of their inner arms. The upper attachment bracket 52 consists of a relatively short inner arm 58 and a slightly longer outer arm 60, whereas the lower attachment bracket 54 has a somewhat longer inner arm 62 and an outer arm 64 of approximately the same length as the outer arm 60 of the upper attachment bracket 52. Both of the attachment brackets 52 and 54 are provided on their upper edges with longitudinally-spaced upper and lower inner notches 66 and 68 (FIG. 5) and near their outer ends are similarly provided with dual upper and lower notches 70 and 72 respectively. These notches, at their open ends, are of approximately the widths of upper and lower O-rings 74 and 76 of resilient material such as rubber or other elastomeric material, adapted to be seated therein, as explained below.

In the use of the invention, let it be assumed that the quiver 10 is detached from the bow 12 and is to be attached thereto. To do so the user places the outer arm 60 of the upper attachment bracket 52 against the side 78 of the upper limb 80 of the bow 12 after threading an upper O-ring 74 upon the outer arm 60 into the inner notches 66 and 68 thereof. He now stretches the upper O-ring 74 around the upper bow limb 80 and around the outer end of the outer arm 60 of the upper attachment bracket 62 and loops it into and around a pair of the outer notches 70 and 72. He then repeats this operation with the lower attachment bracket 54 (FIG. 4) by placing the outer arm 64 thereof against the side 82 of the lower limb 84 of the bow 12 and then looping the lower O-ring 76 from its inner notches 66 and 68 around the lower bow limb 84 and into and around a pair of its outer notches 70 and 72. The quiver 10 and bow 12 are then ready for use in hunting, after arrows 48 have been installed in the quiver 10 with their pointed tips penetrating the pad 22 in the cup 20 and with the lower portions of their shafts snapped into the keyhole notches 44 in the resilient plate 40. The removal of the quiver 10 from the bow 12 is believed to be self-evident as it merely involves reversing the above-described procedure by unlooping the O-rings 74 and 76 from their respective positions around the upper and lower bow limbs 80 and 84 and from the outer ends of their respective outer arms 60 and 64 of their respective attachment brackets 52 and 54.

From the foregoing description and the figures of the drawing, it will be seen that the quiver of the present invention is quickly and easily mounted on or removed from either the right-hand or left-hand side of the bow, to adapt it to the use of either right-handed or left-handed archers. It will also be seen that this quiver is so mounted without drilling the bow or otherwise permanently marring the surface of any part of the bow. Finally, this quiver is extremely light in weight, and therefore adds the minimum of weight to the weight of the bow itself.

It will also be evident from FIG. 2 that the varied spacing of the different notches 70, 72 along the outer arms 60 and 64 enable the attachment brackets 52 and 54 to fit different widths of bow limbs 80 and 84 more closely and tightly than would otherwise be possible, thus preventing slippage of the brackets 52 and 54 relatively to the bow limbs 80 and 84.

I claim:

1. A quick-detachable arrow quiver adapted to be attached to the upper and lower limbs of a conventional archery bow, said quiver comprising a single elongated substantially vertical support bar, an upper arrow holder stationarily secured adjacent an edge thereof to the upper portion of said support bar, a lower arrow holder stationarily secured adjacent an edge thereof to the lower portion of said support bar in vertically-spaced relationship to said upper arrow holder, said lower arrow holder having arrow grippers spaced apart from one another around the entire periphery thereof for releasably gripping a plurality of arrows, and upper and lower L-shaped angle brackets of vertically-elongated cross-section having inner arms secured to said upper and lower portions of said support bar in vertically-spaced relationship thereon and having outer arms adapted to abuttingly engage respectively the rearward faces of the upper and lower limbs of the bow.

2. A quick-detachable arrow quiver, according to claim 1, wherein said outer arms have upper and lower edges with upper and lower notches disposed in pairs therein and wherein said pairs of notches are spaced apart from one another along said arms.

3. A quick-detachable arrow quiver, according to claim 1, wherein said elongated flexible securing elements are endless resilient securing elements.

4. A quick-detachable arrow quiver, according to claim 1, wherein said lower arrow holder is of elongated approximately oval outline, and wherein said support bar is disposed on the a side of said arrow holder.

* * * * *